US009404491B2

(12) United States Patent
Forni

(10) Patent No.: US 9,404,491 B2
(45) Date of Patent: Aug. 2, 2016

(54) SCROLL PUMP HAVING BELLOWS PROVIDING ANGULAR SYNCHRONIZATION AND BACK-UP SYSTEM FOR BELLOWS

(71) Applicant: AGILENT TECHNOLOGIES, INC., Loveland, CO (US)

(72) Inventor: Ronald J. Forni, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 213 days.

(21) Appl. No.: 13/798,613

(22) Filed: Mar. 13, 2013

(65) Prior Publication Data

US 2014/0271305 A1 Sep. 18, 2014

(51) Int. Cl.

| | |
|---|---|
| ***F04C 2/00*** | (2006.01) |
| ***F04C 2/02*** | (2006.01) |
| ***F01C 17/06*** | (2006.01) |
| ***F04C 25/02*** | (2006.01) |
| ***F04C 18/02*** | (2006.01) |

(52) U.S. Cl.

CPC ..... *F04C 2/025* (2013.01); *F01C 17/06* (2013.01); *F04C 18/0215* (2013.01); *F04C 25/02* (2013.01)

(58) Field of Classification Search

CPC ..... F04C 18/0215; F04C 18/0246; F04C 23/008; F04C 18/02; F01C 1/0215; F01C 1/0246; F01C 17/06; F01C 17/066; F01C 1/02

USPC ..... 418/55.3, 55.5, 57, 55.1–55.2

See application file for complete search history.

(56) References Cited

U.S. PATENT DOCUMENTS

| | | | | |
|---|---|---|---|---|
| 1,376,291 | A | 4/1921 | Rolkerr | |
| 3,802,809 | A | 4/1974 | Vulliez | |
| 3,817,664 | A | 6/1974 | Bennett et al. | |
| 4,460,321 | A | 7/1984 | Terauchi | |
| 4,604,039 | A | 8/1986 | Terauchi | |
| 4,731,000 | A | 3/1988 | Haag | |
| 4,795,323 | A * | 1/1989 | Lessie | 418/55.3 |

(Continued)

FOREIGN PATENT DOCUMENTS

| | | |
|---|---|---|
| EP | 1085211 | 3/2001 |
| JP | 61123789 | 6/1986 |

(Continued)

OTHER PUBLICATIONS

Search Report mailed Sep. 30, 2014 in UK Application No. GB1402163.8.

(Continued)

*Primary Examiner* — Kenneth Bomberg
*Assistant Examiner* — Jason T Newton

(57) ABSTRACT

A scroll pump has a metallic bellows that angularly synchronizes the stationary and orbiting scroll blades of the pump, and a hack-up system for the bellows. The back-up system consists of pins integral with and fixed relative to one of the stationary and orbital parts of the scroll pump, and a guide part that is integral with and fixed relative to the other of the stationary and orbital parts. The back-up system may be a non-contacting hack-up system in which there is no contact between the pins and guide part during normal operation of the pump. Therefore, no particles are created by a wearing away of such parts which would otherwise have the potential to contaminate the fluid being worked by the pump and reduce the useful life of the pump.

11 Claims, 4 Drawing Sheets

(56) References Cited

U.S. PATENT DOCUMENTS

| | | | | |
|---|---|---|---|---|
| 4,927,340 | A * | 5/1990 | McCullough | 418/55.3 |
| 5,051,075 | A | 9/1991 | Young | |
| 5,147,192 | A * | 9/1992 | Suzuki et al. | 418/55.3 |
| 5,149,255 | A * | 9/1992 | Young | 418/55.3 |
| 5,178,526 | A * | 1/1993 | Galante et al. | 418/55.3 |
| 5,328,341 | A * | 7/1994 | Forni | 418/55.3 |
| 5,342,186 | A | 8/1994 | Swain | |
| 5,951,268 | A | 9/1999 | Pottier et al. | |
| 5,951,272 | A * | 9/1999 | Fukuhara et al. | 418/55.4 |
| 6,022,202 | A | 2/2000 | Pottier et al. | |
| 6,050,793 | A * | 4/2000 | Barthod et al. | 418/55.1 |
| 6,461,129 | B2 | 10/2002 | Liu | |
| 7,261,528 | B2 * | 8/2007 | Liepert et al. | 418/55.3 |
| 7,442,016 | B2 | 10/2008 | Dovey et al. | |
| 7,654,805 | B2 * | 2/2010 | Ishikawa | 418/55.3 |
| 8,591,210 | B2 | 11/2013 | Collie | |
| 2002/0119062 | A1 | 8/2002 | Liu | |
| 2005/0220647 | A1 | 10/2005 | Liepert et al. | |
| 2007/0110605 | A1 | 5/2007 | Masuda | |
| 2008/0124236 | A1 * | 5/2008 | Schofield | 418/55.1 |
| 2009/0180909 | A1 * | 7/2009 | Schofield et al. | 418/55.1 |

FOREIGN PATENT DOCUMENTS

| | | |
|---|---|---|
| JP | 2010001858 | 1/2010 |
| WO | WO2004072483 | 8/2004 |
| WO | WO2005045249 | 5/2005 |
| WO | WO2006061559 | 6/2006 |

OTHER PUBLICATIONS

Machine translation of JP2010001858 published Jan. 7, 2010.

Office Action mailed Jun. 18, 2014 in Chinese Application No. 201420064991.5 (Unofficial/non-certified translationprovided by foreign agent).

Office Action mailed Mar. 23, 2015 in co-pending U.S. Appl. No. 13/857,490.

Office Action mailed Dec. 4, 2014 in co-pending U.S. Appl. No. 13/857,490.

Search Report mailed Sep. 16, 2014 in UK Application No. GB1400495.6.

Office Action mailed Jun. 18, 2014 in Chinese Application No. 201420098646.3 (Unofficial/non-certified translation provided by foreign agent included).

Notice of Allowance dated Feb. 10, 2016 from related U.S. Appl. No. 14/094,683.

* cited by examiner

SCROLL PUMP HAVING BELLOWS PROVIDING ANGULAR SYNCHRONIZATION AND BACK-UP SYSTEM FOR BELLOWS

BACKGROUND

1. Field of the Invention

The present invention relates to a scroll pump having a pump head assembly that includes a stationary plate scroll and an orbiting plate scroll having stationary and orbiting scroll blades, respectively, in particular, the present invention relates to the means used to angularly synchronize stationary and orbiting scroll blades in a scroll pump.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a radial clearance and predetermined relative angular positioning such that a pocket (or pockets) is delimited by and between the blades. The scroll pump also has a frame to which the stationary plate scroll is fixed and an eccentric drive mechanism supported by the frame. These parts generally make up an assembly that may be referred to as a pump head assembly of the scroll pump.

The orbiting scroll plate and hence, the orbiting scroll blade, is coupled to and driven by the eccentric driving mechanism so as to orbit about a longitudinal axis of the pump passing through the axial center of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed of from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is compressed. Thus, the fluid in the pocket is compressed and thereby discharged through the outlet of the pump.

In the case of a vacuum-type of scroll pump, the inlet of the pump is connected to a chamber that is to be evacuated. Conversely, in the case of a compressor-type of scroll pump, the outlet of the pump is connected to a chamber that is to be supplied with pressurized fluid by the pump.

In any case, the predetermined angular position of the orbiting scroll blade relative to the stationary scroll blade must be provided and maintained within certain tolerances if the above-described intake and discharge operations are to be executed satisfactorily by the scroll pump. More specifically, the orbiting plate scroll must maintain a certain angular synchronization with the stationary plate scroll if seals created by and between the stationary and orbiting scroll blades are to form the pocket(s) stably, cause the volume of the pocket(s) to vary appropriately, and effectively cause the pocket(s) to move through the pump head assembly with the timing required relative to the inlet and outlet of the pump. To this end, the orbiting plate scroll must not rotate in excess of a certain amount about its own central axis while it orbits about the longitudinal axis of the pump head assembly.

SUMMARY

It is an object of the present invention to provide a scroll pump having a primary means of angularly synchronizing the stationary and orbiting scroll blades of the pump, and a back-up system for the primary means, and neither of which have a tendency to create particles during normal operation of the pump and/or shorten the useful life of the pump.

It is another object of the present invention to provide a scroll pump having a primary means of angularly synchronizing the stationary and orbiting scroll blades of the pump, and a back-up system for the primary means, constituted by relatively simple and low cost structures that are easy to implement.

It is still another object of the present invention to provide a scroll pump having a primary means of angularly synchronizing the stationary and orbiting scroll blades of the pump, and a back-up system which maintains the angular synchronization in cases in which an excessive drive load is exerted on the orbiting scroll blade.

It is still another object of the present invention to provide a scroll pump having a primary means of angularly synchronizing the stationary and orbiting scroll blades of the pump, and a back-up system which can prevent the pump from being damaged should the primary means fail.

According to one aspect of the present invention, there is provided a scroll pump that includes a frame, a stationary plate scroll fixed to the frame and having a stationary scroll blade centered about a longitudinal axis of the pump, an orbiting scroll having an orbiting scroll blade juxtaposed with the stationary scroll blade in a radial direction of the pump such that the stationary and orbiting scroll blades are nested, an eccentric drive mechanism supported by the frame and operatively connected to the orbiting scroll blade so as to cause the orbiting scroll blade to orbit about the longitudinal axis, a metallic bellows that angularly synchronizes the orbiting and stationary scroll blades, and a non-contacting back-up system for the bellows.

The metallic bellows is fixed at a first end thereof to the orbiting plate scroll, and the frame is fixed to the metallic bellows at the second end of the metallic bellows such that the metallic bellows angularly synchronizes the orbiting and stationary scroll blades. The eccentric drive mechanism supports the orbiting scroll blade so as to be rotatable about a second axis that is parallel to the longitudinal axis. Thus, the orbiting plate scroll is an orbital part of the pump whereas the frame and the stationary plate scroll are a stationary part of the pump.

The non-contacting back-up system has a plurality of pins extending axially in directions parallel to the longitudinal axis of the pump from one of the stationary and orbital parts of the pump, and a guide part fixed relative to the other of the stationary and orbital parts of the pump. Several openings are defined in the guide part. The openings also extend axially in directions parallel to the longitudinal axis of the pump, and the pins extend axially into the openings, respectively. Furthermore, in normal operating conditions, each of the pins is spaced in its entirety from the stationary or orbital part of the pump to which the guide part is fixed and such that a radial clearance exists between each pin and the surface of the guide part that delimits the opening into which the pin extends.

According to another aspect of the present invention, there is provided a scroll pump that includes a scroll blade set including a stationary scroll blade fixed in the pump and an orbiting scroll blade juxtaposed with the stationary scroll blade in a radial direction of the pump such that the stationary and orbiting scroll blades are nested, an eccentric drive mechanism operatively connected to the orbiting scroll blade so as to cause the orbiting scroll blade to orbit about a longitudinal axis, a metallic bellows that angularly synchronizes the orbiting and stationary scroll blades, and angular synchronization back-up means for maintaining an angular synchronization between the orbiting and stationary scroll blades in the event that a load on the orbiting scroll blade exceeds a rated drive load of the scroll pump.

The metallic bellows has first and second ends. The second end of the bellows is fixed in the pump, and the orbiting scroll blade is fixed to the metallic bellows at the first end of the metallic bellows. The angular synchronization back-up means comprises a plurality of pins, and a guide part in which a plurality of openings open in directions parallel to the longitudinal axis of the pump are defined. The pins are fixed relative to one of the stationary and orbiting scroll blades in the pump, the guide part in which the openings are defined is fixed relative to the other of the stationary and orbiting scroll blades in the pump, and the pins extend axially in the directions parallel to the longitudinal axis into the openings, respectively.

According to still another aspect of the present invention, there is provided a scroll pump that includes a scroll blade set including a stationary scroll blade fixed in the pump and an orbiting scroll blade juxtaposed with the stationary scroll blade in a radial direction of the pump such that the stationary and orbiting scroll blades are nested, an eccentric drive mechanism operatively connected to the orbiting scroll blade so as to cause the orbiting scroll blade to orbit about a longitudinal axis, a metallic bellows as the only means of angularly synchronizing the orbiting and stationary scroll blades, and back-up means for preventing damage to the pump if the metallic bellows should fail.

The metallic bellows has first and second ends. The second end of the bellows is fixed in the pump, and the orbiting scroll blade is fixed to the metallic bellows at the first end of the metallic bellows. The back-up means comprises a plurality of pins, and a guide part in which a plurality of openings open in directions parallel to the longitudinal axis of the pump are defined. The pins are fixed relative to one of the stationary and orbiting scroll blades in the pump, the guide part in which the openings are defined is fixed relative to the other of the stationary and orbiting scroll blades in the pump, and the pins extend axially in the directions parallel to the longitudinal axis into the openings, respectively.

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION

Figure 1:
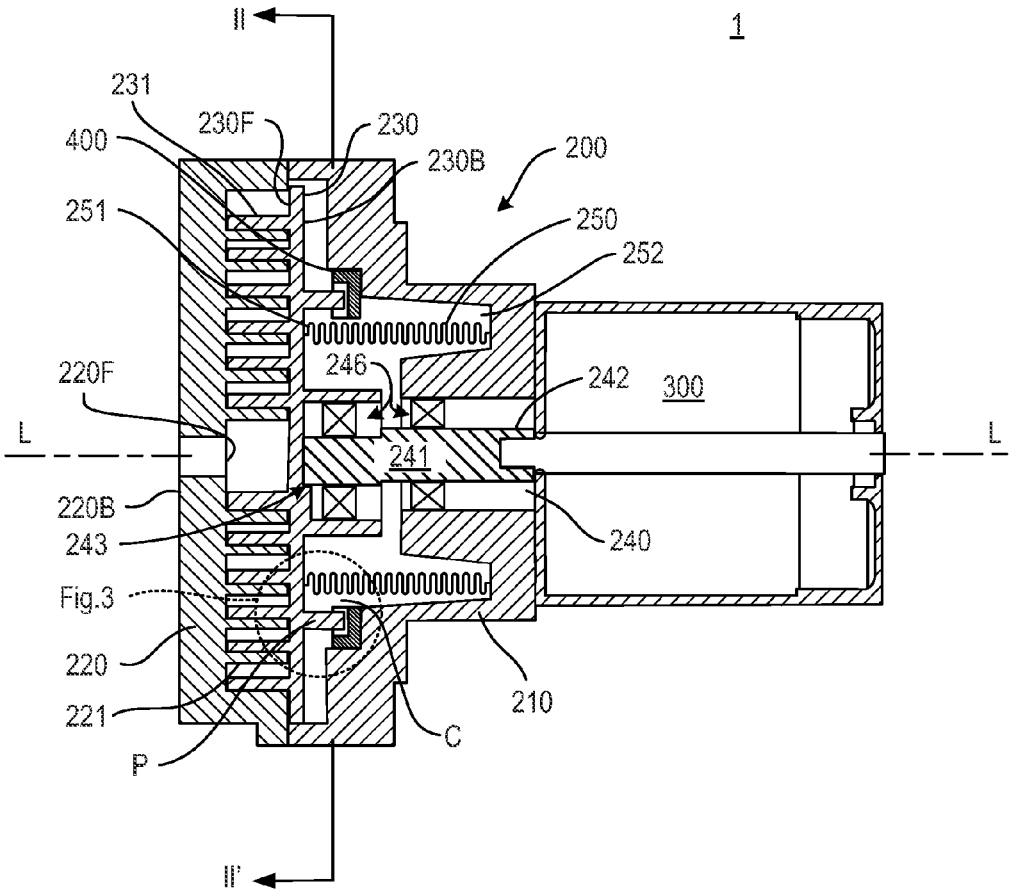
FIG. 1 is a schematic longitudinal sectional view of a simplified version of a scroll pump according to the present invention.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, spatially relative terms, such as "front" and "back" are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Other terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. The term "pump" may refer to apparatus that drives, or raises or decreases the pressure of a fluid, etc. The term "fixed" or "coupled" may be used to describe a direct connection of two parts to one another in such a way that the parts can not move relative to one another or a connection of the parts through the intermediary of one or more additional parts in such a way that the parts can not move relative to each other. The term "normal" operation of the pump or "normal" loads on the orbiting plate scroll will be understood by the those skilled in the art to refer to the rated conditions or rated loads, i.e., which constitute the design specifications of the pump, and which are readily ascertainable in the real world and may be found in the manual or the like accompanying a scroll pump when it is sold.

Referring now to FIG. 1, a scroll pump 1 to which the present invention may be applied includes a housing (not shown), and a pump head assembly 200 and a motor 300 having a rotary output disposed in the housing. The pump head assembly 200 includes a frame 210, a stationary plate scroll 220, an orbiting plate scroll 230, an eccentric drive mechanism 240, an annular metallic bellows 250 and fasteners (to be described in more detail later on) fixing the stationary plate scroll 220 to the frame 210 and the annular metallic bellows 250 to both the frame 210 and the orbiting plate scroll 230.

The frame 210 may be of one unitary piece, as shown in the figure, or may comprise several integral parts that are fixed to one another.

The stationary plate scroll 220 is fixed to the frame 210. The stationary plate scroll 220 has a front side 220F and a back side 220B, and comprises a stationary scroll blade 221 at its front side 220F. The orbiting plate scroll 230 has a front side 230F and a back side 230B, and comprises an orbiting scroll blade 231, at its front side. The stationary scroll blade 221 and the orbiting scroll blade 231 are nested with a clearance and predetermined relative angular positioning such that a pocket or pockets is/are delimited by and between the stationary and orbiting scroll blades 221 and 231. In this respect, portions of the stationary scroll blade 221 and the orbiting scroll blade 231 need not contact each other to seal the pocket(s). Rather, minute radial clearances between portions of the stationary scroll blade 221 and the orbiting scroll blade 231 create a seal sufficient for forming a satisfactory pocket(s) and prevent excessive noise which would otherwise be produced if the stationary scroll blade 221 and orbiting scroll blade 231 were contacting each other.

The eccentric drive mechanism 240 includes a drive shaft 241 and bearings 246. In this example, the drive shaft 241 is a crank shaft having a main portion 242 coupled to the motor 300 so as to be rotated by the motor about a longitudinal axis L of the scroll pump 1, and a crank 243 whose central longitudinal axis is offset in a radial direction from the longitudinal axis L. Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis L of the scroll pump 1 when the main portion 242 is rotated by the motor 300, and the orbiting plate scroll 230 is supported by the crank 243 so as to be rotatable about the central longitudinal axis of the crank 243.

During a normal operation of the scroll pump 1, loads on the orbiting scroll blade 231 tend to cause the orbiting plate scroll 230 to rotate about the central longitudinal axis of the crank 243. However, the annular metallic bellows 250 restrains the orbiting plate scroll 230 in such a way as to allow it to orbit about the longitudinal axis L of the scroll pump 1 while inhibiting its rotation about the central longitudinal axis of the crank 243.

More specifically, the annular metallic bellows 250 has a first end 251 at which the annular metallic bellows 250 is fixed to the back side 230B of the orbiting plate scroll 230 and a second end 252 at which the annular metallic bellows 250 is fixed to the frame 210. In this respect, the annular metallic bellows 250 is radially flexible enough to allow the first end 251 thereof to follow along with the orbiting plate scroll 230 while the second end 252 of the annular metallic bellows 250 remains fixed to the frame 210. On the other hand, the annular metallic bellows 250 has a torsional stiffness that prevents the first end 251 of the annular metallic bellows 250 from rotating significantly about the central longitudinal axis of the annular metallic bellows 250, i.e., from rotating significantly in its circumferential direction, while the second end 252 of the annular metallic bellows 250 remains fixed to the frame 210.

In the pump head assembly 200 of the present invention, the specifications of the annular metallic bellows 250, e.g., the wall thickness, etc., which impart the torsional stiffness to the annular metallic bellows 250 are designed such that the first end 251 of the annular metallic bellows 250 will not rotate more than a minimal amount in its circumferential direction under normal loads applied to the orbiting plate scroll 230.

In this embodiment, the annular metallic bellows 250 is essentially the only means of providing the angular synchronization of the stationary scroll blade 221 and the orbiting scroll blade 231 during the normal operation of the scroll pump 1.

Furthermore, not only does the annular metallic bellows 250 extend between the frame 210 and the back side 230B of the orbiting plate scroll 230, but the annular metallic bellows 250 also extends around a portion of the drive shaft 241 and the bearings 246 of the eccentric drive mechanism 240. In this way, the annular metallic bellows 250 may also seal the bearings 246 and bearing surfaces from a space defined between the annular metallic bellows 250 and the frame 210 in the radial direction and which space may constitute a chamber C, e.g., a vacuum chamber of the scroll pump 1, through which fluid worked by the scroll pump 1 passes. Accordingly, lubricant employed by the bearings 246 and/or particulate matter generated by the bearings surfaces can be prevented from passing into the chamber C by the annular metallic bellows 250.

A back-up system for the annular metallic bellows 250 will now be described with reference to FIGS. 1-4. As is clear from the description above, the frame 210 and the stationary plate scroll 220 are a stationary part of the scroll pump 1, and the orbiting plate scroll 230 is an orbiting part of the scroll pump 1.

The back-up system consists of pins P integral with and fixed relative to one of the stationary and orbital parts, and a guide part 400 that is integral with and fixed relative to the other of the stationary and orbital parts. According to one aspect of the present invention, the back-up system is a non-contacting back-up system meaning that there is no contact between the pins P and the guide part 400 during normal operation of the scroll pump 1. Therefore, no particles are created by a wearing away of such parts which would otherwise have the potential to contaminate the fluid being worked by the scroll pump 1, and reduce the useful life of the backup system and hence the scroll pump 1 as well.

Figure 3:
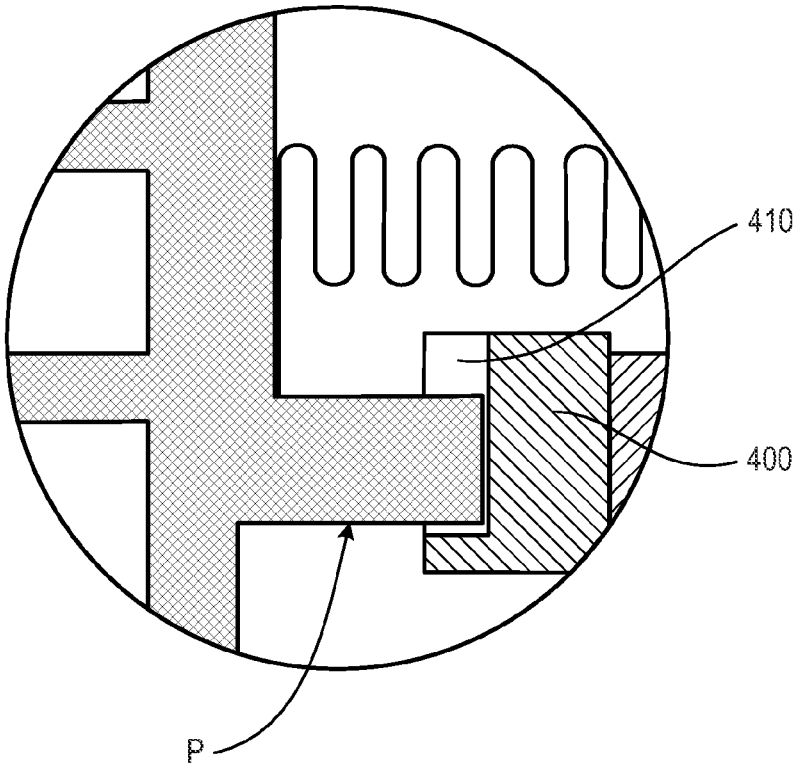
FIG. 3 is an enlarged view of a portion of the scroll pump shown in FIG. 1, again in a simplified form.

The pins P extend axially in directions parallel to the longitudinal axis L of the scroll pump 1, and the guide part 400 defines openings 410 open in and also extending axially in directions parallel to the longitudinal axis L of the scroll pump 1. The pins P, as best seen in FIG. 3, extend axially into the openings 410, respectively, from locations outside the openings 410. Also, as shown in the figures, the openings 410 may open radially inwardly toward the longitudinal axis L of the scroll pump 1.

Also, in the example illustrated in FIGS. 1-4, the pins P extend from the orbital part of the scroll pump 1, and the guide part 400 is integral with and fixed relative to the stationary part of the scroll pump 1. More specifically, the pins P are integral with the orbiting plate scroll 230 and extend axially from the back side 230B thereof in a direction away from the orbiting scroll blade 231, and the guide part 400 is integral with the frame 210. In this respect, the guide part 400 may be unitary with the frame 210 or may be a separate part that is integrated with the frame 210. In this example, the guide part 400 is an annular member that is seated in a face of the frame 210 and fixed to the frame 210.

In another example, the pins P extend axially from the orbiting plate scroll 230 at the front side 230F thereof, and the guide part 400 is integral with and fixed relative to the stationary plate scroll 220.

Figure 2:
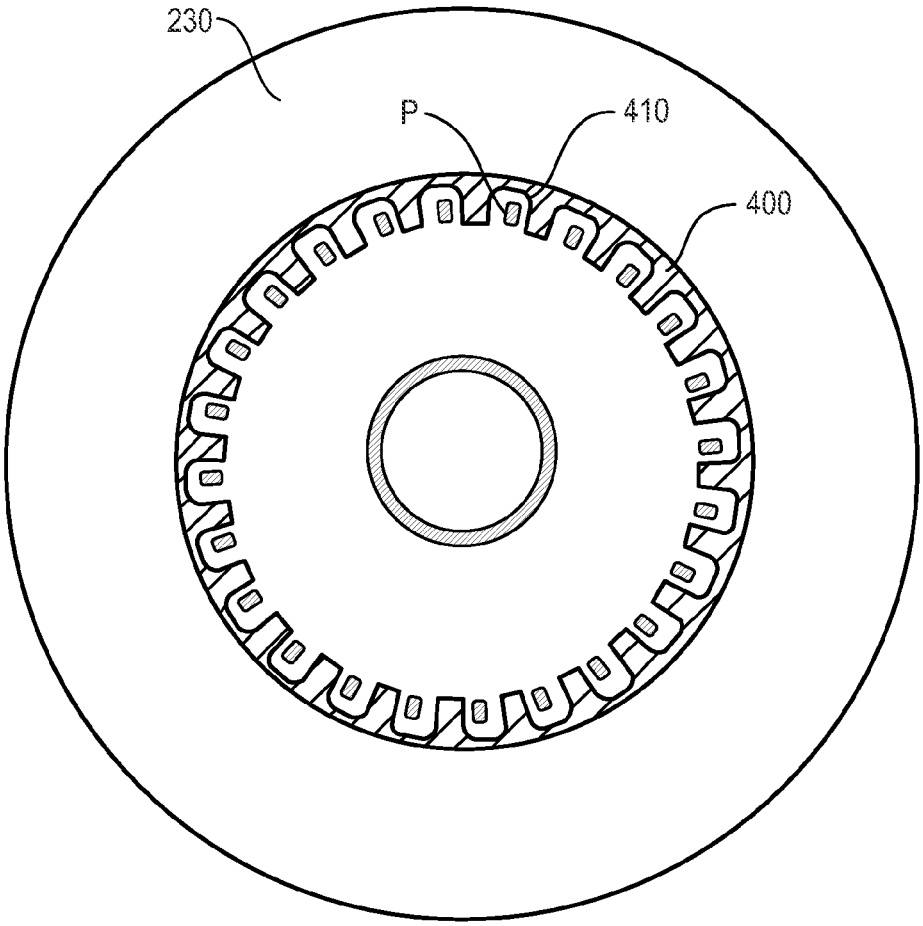
FIG. 2 is a cross-sectional view of selected parts of the scroll pump taken along line II-II' of FIG.
Figure 4:
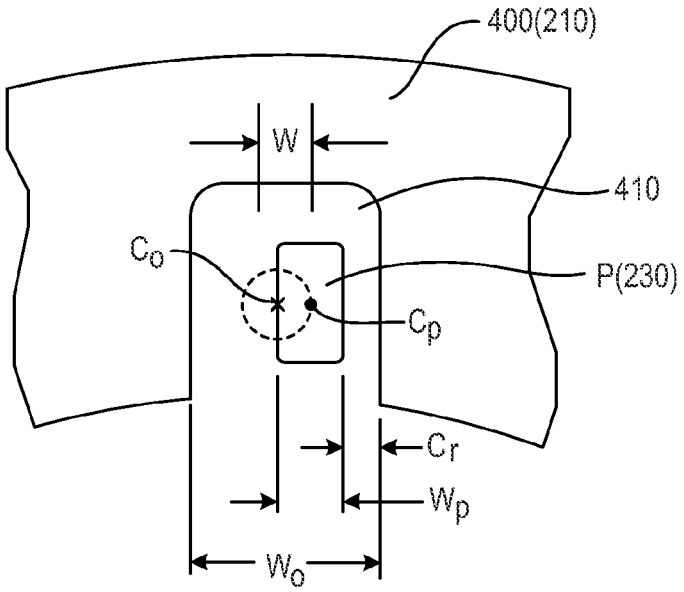
FIG. 4 is a schematic cross-sectional view, taken in the same direction as that of FIG. 2, of part of the back-up system of the scroll pump according to the present invention.

FIGS. 2 and 4 show the non-contacting state of the pins P and guide part 400, which is the state that exists when the scroll pump 1 is operating normally or at rest. Note, in this state, the orbiting plate scroll 230 is in its eccentric (radially offset) position relative to the stationary plate scroll 220.

Referring to FIG. 4, in this example, each of the pins P fixed relative to the orbital part of the scroll pump 1 is spaced from the stationary part of the scroll pump 1 and in this respect, a radial clearance $C_r$ exists between each pin P and the surface of the guide part 400 that delimits the opening 410 into which the pin P extends. Furthermore, the geometric axial center $C_p$ of each of the pins P is offset from the geometric axial center $C_o$ of the opening 410 into which the pin P extends. Therefore, the geometric axial center $C_p$ of the pin P traverses an orbit (shown by the dashed lines) about the geometric axial center $C_o$ of the opening 410 as the orbiting scroll blade 231 is being driven by the eccentric drive mechanism 240. The clearance $C_r$ between the pins P and the surfaces of the guide part 400 that delimit the openings 410 is critical for reasons that follow.

When an abnormal operation of the scroll pump 1 occurs, the pins P will contact the surfaces delimiting the openings 410 of the guide part 400 into which the pins P extend. The abnormal condition of the scroll pump 1 may be a case in which the annular metallic bellows 250 fails. In this case, the guide part 400 keeps the orbiting plate scroll 230 from rotating excessively about the central axis of the crank 243 as it continues to orbit about the central longitudinal axis L of the scroll pump 1. This means that the clearance $C_r$ at a minimum prevents the orbiting scroll blade 231 from colliding so violently with the stationary scroll blade 221 as to damage the scroll blade(s) 221, 231 before the scroll pump 1 can be shut down.

However, an abnormal operation may also refer to a situation in which a load exerted on the orbiting scroll blade 231 is so great (e.g., greater than a rated load of the scroll pump 1) as to overcome the torsional resistance offered by the annular metallic bellows 250 at the first end 251 thereof but without the annular metallic bellows 250 failing. In this case, the contours of the pins P, the surfaces of the guide part 400 delimiting the openings 410, and the clearance $C_r$ are such that the surfaces of the guide part 400 guide the pins P therealong and keep the orbiting plate scroll 230 from rotating excessively about the central axis of the crank 243 as it continues to orbit about the central longitudinal axis L of the scroll pump 1. Moreover, in this case, the clearance $C_r$ is small enough to prevent overloading the annular metallic bellows 250 and radial contact between the stationary scroll blade 221 and orbiting scroll blade 231.

In these respects, it should be noted that radial contact between the stationary and orbiting scroll blades 221 and 231 can occur at less than the rated load of the scroll pump 1 as a result of differential thermal expansion and manufacturing errors. Furthermore, the loads produced by radial contact between the stationary and orbiting scroll blades 221 and 231 are cyclic by nature, the contact occurring at least once per revolution. Therefore, these loads have the potential to fatigue the annular metallic bellows 250.

According to an aspect of the present invention, the clearance $C_r$ is designed to allow for a rotation of the orbiting plate scroll 230 (about its central axis) relative to the stationary plate scroll 220 but prevent the scroll blades 221 and 231 of the stationary and orbiting plate scrolls 220 and 230 from contacting each other and additionally limit the torsion induced stress in the annular metallic bellows 250 in order to prevent fatigue or other damage to the annular metallic bellows 250.

Generally speaking, to provide the proper clearance $C_r$, the width $W_o$ of the opening 410 is set to be the sum of the width WP of the pin P plus the width W of the orbit of the geometric axial center $C_P$ of the pin P plus a predetermined value, $2*C_r$ (all widths being in the circumferential direction of the guide part 400 in this case).

In an example of this embodiment, the clearance $C_r$ is preferably in the range of 0.006" to 0.070" and more preferably, is substantially equal to 0.006".

This range was arrived at based on the following considerations. As should be clear from the explanation above, the geometry of the pins P and openings 410 in the guide part 400 should allow for some rotation of the orbiting plate scroll 230 relative to the stationary plate scroll 220 during normal operation. Also, the geometry must prevent excessive rotation of the orbiting plate scroll 230 during an abnormal operation.

The amount of allowable rotation may be determined by the minimum radial clearance, MRC, between the stationary scroll blade 221 and the orbiting scroll blade 231 and the pitch P of the scroll blades 221 and 231 (distance between successive sections or so-called "wraps" of a blade that traverse 360°). The maximum allowable rotation, measured in degrees (dO), is given by the equation: dO<MRC/(P/360). Typical values for dO are on the order of a couple of degrees depending on the MRC, pitch P, differential thermal expansion, and manufacturing tolerances. A maximum allowable rotation, dO, less than MRC/(P/360) can prevent contact of the stationary and orbiting scroll blades 221 and 231. An even smaller value for dO may be required to prevent excessive rotation of the orbiting end 251 of the annular metallic bellows 250 relative to the fixed end 252 that will lead to excessive stress and failure within the annular metallic bellows 250.

Once the maximum allowable rotation is determined, a window for clearances $C_r$ between the pin P and (the surface defining opening 410 of) the guide part 400 can be estimated.

The maximum clearance $C_r$ between the pin P and the guide part 400 should be no greater than Tan(dO) multiplied by one half of the bolt circle diameter (BCD) of the pins. For dO of 1 degree and a bolt circle diameter of 8" for the pins P, the clearance between each pin P and the associated surface of the guide part 400 defining opening 410 should be no greater than 0.070"=4" *Tan (1 degree). That is, the clearance will need to be less than 0.070" to prevent contact between the stationary scroll blade 221 and the orbiting scroll blade 221 when abnormal operation that brings the pins P into contact with the guide part 400 occurs.

On the other hand, as mentioned above, there is a minimum clearance that keeps the pins P from contacting the guide part 400 during normal operation when the maximum allowable rotation of the orbiting plate scroll 230 relative to the stationary plate scroll 220 occurs. The effects of differential temperature, thermal expansion rates of the pins P and material of the guide part 400, bolt circle diameter of the pins P, and manufacturing tolerances, will determine the minimum clearance.

On these bases, and again with reference to FIG. 4, the width $W_o$ of the opening 410 is set to be the sum of the width $W_p$ of the pin P, plus the width W of the orbit of the geometric center $C_p$ of the pin P, plus a predetermined value $2*C_r$, the predetermined value being less than BCD*Tan (MRC/(Pitch/360)).

In an example of a scroll pump 1 according to the present invention, using the equations above, a window of values which will provide an acceptable clearance $C_r$ was calculated to be in the range of approximately 0.006" to approximately 0.070". It should be clear, though, it is best to select a value close to the minimum value, i.e., to a value substantially equal to approximately 0.006" in this example to prevent the annular metallic bellows 250 from being over rotated and hence over stressed especially in a cyclic pattern leading to fatigue failure.

Referring still to the example shown in FIG. 4, the pins P and openings 410 each have a generally rectangular cross section (in a plane perpendicular to the longitudinal axis L). However, the pins P and openings 410 may have other polygonal cross-sectional shapes, such as trapezoidal.

Figure 5:
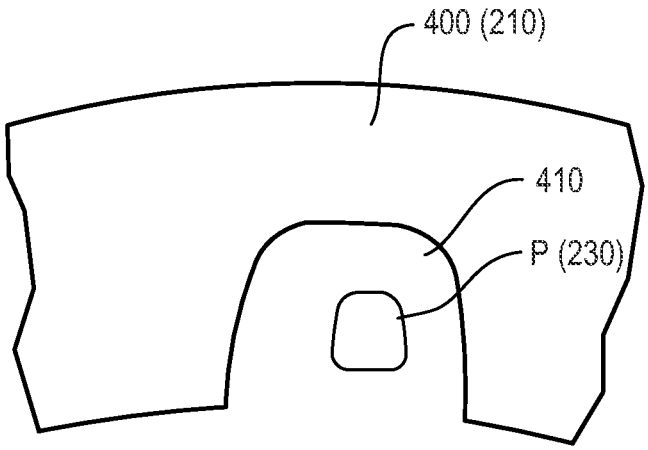
FIG. 5 is a schematic cross-sectional view similar to the of FIG. 4 but of part of another example of the back-up system of the scroll pump according to the present invention.

FIG. 5 schematically shows another example of the back-up system of the scroll pump 1 according to the present invention. In this example, the pins P and the surfaces of the guide part 400 that define the openings 410 have corresponding profiles of gear teeth, e.g., each has an involute type of gear tooth profile.

Figure 6:
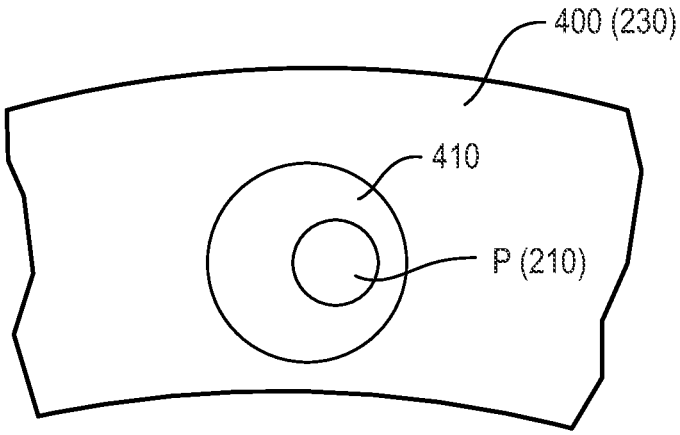
FIG. 6 is a schematic cross-sectional view similar to the of FIG. 4 but of part of still another example of the back-up system of the scroll pump according to the present invention.

FIG. 6 schematically shows another example of the back-up system of the scroll pump 1 according to the present invention. In this example, the guide part 400 is integral with and fixed relative to the orbiting plate scroll 230 at the back side 230B thereof, whereas the pins P extend from the frame 210 into the openings 410, respectively. Alternatively, the guide part 400 may be integral with and fixed relative to the orbiting plate scroll 230 at the front side 230F thereof, whereas the pins P extend axially from the stationary plate scroll 220 into the openings 410, respectively.

Also, in the example shown in FIG. 6, the pins P and the openings 410 have round cross sections in a plane perpendicular to the longitudinal axis L. Further, in this respect, as shown in the figure, the cross-sections of the openings 410 are closed unlike the openings 410 in the example shown in FIG. 4. It is also clear that other examples of a scroll pump 1 in accordance with the present invention can employ other combinations of individual features described above with reference to FIGS. 4-6. For example, the back-up system may have round pins P as shown in and described with reference to FIG. 6 extending from the frame 210 as described with reference to FIG. 4, and the openings 410 in the guide part 400 may have semi-circular cross-sectional shapes which open radially inwardly.

That is, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A scroll pump comprising:

a frame;

a stationary plate scroll fixed to the frame and comprising a stationary scroll blade centered about a longitudinal axis of the scroll pump, wherein the frame and the stationary plate scroll are a stationary part of the scroll pump;

an orbiting plate scroll comprising an orbiting scroll blade juxtaposed with the stationary scroll blade in a radial direction of the scroll pump such that the stationary scroll blade and the orbiting scroll blade are nested;

an eccentric drive mechanism supported by the frame and operatively connected to the orbiting scroll blade so as to cause the orbiting scroll blade to orbit about the longitudinal axis of the scroll pump, and wherein the eccentric drive mechanism supports the orbiting scroll blade so as to be rotatable about a second axis that is parallel to the longitudinal axis of the scroll pump, wherein the orbiting plate scroll is an orbital part of the scroll pump;

a metallic bellows comprising a first end and a second end, the metallic bellows being fixed at the second end to the frame, and the orbiting scroll blade being fixed to the metallic bellows at the first end such that the metallic bellows angularly synchronizes the orbiting scroll blade and the stationary scroll blade; and a non-contacting back-up system comprising a plurality of pins extending axially in directions parallel to the longitudinal axis of the scroll pump from one of the stationary and orbital parts of the scroll pump, and a guide part fixed relative to the other of the stationary and orbital parts of the scroll pump, the guide part comprising a plurality of surfaces defining a plurality of respective openings extending axially in the directions parallel to the longitudinal axis of the scroll pump, wherein:

each of the plurality of pins extends axially into a respective one of the openings, and each of the plurality of pins is spaced in its entirety from the other of the stationary and orbital parts of the scroll pump such that a radial clearance exists between each pin of the plurality of pins and each respective surface.

2. The scroll pump as claimed in claim 1, wherein, for each pin of the plurality of pins and the respective opening of the plurality of openings into which the pin extends, a geometric axial center of the pin is offset from a geometric axial center of the respective opening such that the geometric axial center of the pin traverses an orbit about the geometric axial center of the respective opening as the orbiting scroll blade is being driven by the eccentric drive mechanism.

3. The scroll pump as claimed in claim 2, wherein, for each pin of the plurality of pins and the respective opening of the plurality of openings into which the pin extends:

the pin has a width, the opening has a width, and the orbit of the geometric center of the pin has a width;

the width of the opening is the sum of the width of the pin, plus the width of the orbit of the geometric center of the pin, plus a predetermined value less than BCD*Tan (MRC/(Pitch/360)), wherein BCD is the Bolt Circle Diameter of the pin, MRC is the minimum radial clearance between the stationary scroll blade and the orbiting scroll blade, and Pitch is the distance in the radial direction between successive wraps of the stationary scroll blade and the orbiting scroll blade.

4. The scroll pump as claimed in claim 1, wherein the orbiting scroll blade is disposed at a front side of the orbiting plate scroll, each of the plurality of pins is integral with the orbiting plate scroll and extends axially from a back side thereof in a direction away from the orbiting scroll blade, and the guide part is integral with the frame.

5. The scroll pump as claimed in claim 1, wherein the metallic bellows angularly synchronizes the orbiting scroll blade and the stationary scroll blade in the scroll pump when the load on the orbiting scroll blade is less than a predetermined rated load of the orbiting scroll blade, whereby each of the plurality of pins engages the respective surface of the guide part if the metallic bellows should fail.

6. The scroll pump as claimed in claim 1, wherein the metallic bellows angularly synchronizes the orbiting scroll blade and the stationary scroll blade in the scroll pump when the scroll pump is operating normally, and each of the plurality of pins only engages the respective surface of the guide part when an abnormal operation of the scroll pump occurs.

7. The scroll pump as claimed in claim 1, wherein the metallic bellows has a torsional stiffness that suppresses rotation of the orbiting plate scroll about the second axis up to a rated load of the orbiting plate scroll in the scroll pump, and the radial clearance between each of the plurality of pins and the respective surface of the guide part is maintained as long as the load on the orbiting scroll blade is less than a rated load of the scroll pump.

8. A scroll pump comprising:

a scroll blade set comprising a stationary scroll blade fixed in the scroll pump and an orbiting scroll blade juxtaposed with the stationary scroll blade in a radial direction of the scroll pump, wherein the stationary scroll blade and the orbiting scroll blade are nested;

an eccentric drive mechanism operatively connected to the orbiting scroll blade so as to cause the orbiting scroll blade to orbit about a longitudinal axis;

a metallic bellows comprising a first end and a second end, the second end being fixed in the scroll pump, and the orbiting scroll blade being operatively connected to the metallic bellows at the first end such that the metallic bellows angularly synchronizes the orbiting scroll blade and the stationary scroll blade; and an angular synchronization back-up system for maintaining an angular synchronization between the orbiting scroll blade and the stationary scroll blade in the event that a load on the orbiting scroll blade exceeds a rated load of the scroll pump, wherein:

the angular synchronization back-up system comprises a plurality of pins extending axially in directions parallel to the longitudinal axis, and a guide part in which a plurality of openings open in the directions parallel to the longitudinal axis is defined;

the plurality of pins is fixed relative to one of the stationary and orbiting scroll blades in the scroll pump, the guide part is fixed relative to the other of the stationary and orbiting scroll blades in the scroll pump, and the pins of the plurality of pins extend axially in the directions parallel to the longitudinal axis into the plurality of openings, respectively;

the guide part comprises a plurality of surfaces respectively defining the plurality of openings into which the pins of the plurality of pins respectively extend;

a radial clearance exists in all directions between each pin of the plurality of pins and each respective surface of the plurality of surfaces, as long as the load on the orbiting scroll blade is less than the rated load; and for each pin of the plurality of pins and the respective opening of the plurality of openings into which the pin extends, a geometric axial center of the pin is offset from a geometric axial center of the respective opening such that the geometric axial center of the pin traverses an orbit about the geometric axial center of the respective opening as the orbiting scroll blade is being driven by the eccentric drive mechanism.

9. The scroll pump as claimed in claim 8, wherein the metallic bellows angularly synchronizes the orbiting scroll blade and the stationary scroll blade in the scroll pump when the load on the orbiting scroll blade is less than the rated load.

10. The scroll pump as claimed in claim 8, wherein, for each pin of the plurality of pins and the respective opening of the plurality of openings into which the pin extends:

the pin has a width, the opening has a width, and the orbit of the geometric center of the pin has a width;

the width of the opening is the sum of the width of the pin, plus the width of the orbit of the geometric axial center of the pin, plus a predetermined value less than BCD*Tan (MRC/(Pitch/360)), wherein BCD is the Bolt Circle Diameter of the pin, MRC is the minimum radial clearance between the stationary scroll blade and the orbiting scroll blade, and Pitch is the distance in the radial direction between successive wraps of the stationary scroll blade and the orbiting scroll blade.

11. The scroll pump as claimed in claim 8, further comprising a frame, and wherein the stationary scroll blade is fixed relative to the frame, the eccentric drive mechanism is supported by the frame, the metallic bellows is fixed at the second end thereof to the frame, and the guide part is integral with the frame, and the pins of the plurality of pins extend axially in a direction away from the orbiting scroll blade into the openings, respectively, of the plurality of openings of the guide part.

* * * * *